US012109461B2

(12) United States Patent
Mizutani et al.

(10) Patent No.: US 12,109,461 B2
(45) Date of Patent: Oct. 8, 2024

(54) GOLF CLUB HEAD

(71) Applicant: SUMITOMO RUBBER INDUSTRIES, LTD., Kobe (JP)

(72) Inventors: Naruhiro Mizutani, Kobe (JP); Daisuke Kohno, Kobe (JP); Masahiko Ueda, Kobe (JP); Yuki Nagano, Kobe (JP); Satoru Hanamitsu, Kobe (JP); Naoyoshi Ueda, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 104 days.

(21) Appl. No.: 17/592,819

(22) Filed: Feb. 4, 2022

(65) Prior Publication Data

US 2022/0249921 A1 Aug. 11, 2022

(30) Foreign Application Priority Data

Feb. 5, 2021 (JP) ..... 2021-017094

(51) Int. Cl.
*A63B 53/04* (2015.01)

(52) U.S. Cl.
CPC ..... *A63B 53/0408* (2020.08); *A63B 53/0466* (2013.01); *A63B 2209/023* (2013.01)

(58) Field of Classification Search
CPC . A63B 53/0408; A63B 53/0466; A63B 53/04; A63B 53/0416
See application file for complete search history.

(56) References Cited

U.S. PATENT DOCUMENTS 6,099,414 A * 8/2000 Kusano ..... A63B 60/00 473/345
7,559,853 B2 * 7/2009 Hirano ..... A63B 53/0466 473/324
10,413,789 B1 * 9/2019 Seluga ..... A63B 60/00
2002/0055396 A1 * 5/2002 Nishimoto ..... A63B 60/00 473/345
2002/0065146 A1 * 5/2002 Kusumoto ..... A63B 60/00 473/345
2003/0036442 A1 * 2/2003 Chao ..... A63B 53/0466 473/345

(Continued)

FOREIGN PATENT DOCUMENTS

JP 09028842 A * 2/1997
JP 2002035179 A * 2/2002

(Continued)

*Primary Examiner* — William M Pierce
(74) *Attorney, Agent, or Firm* — Birch, Stewart, Kolasch & Birch, LLP

(57) ABSTRACT

A head includes a body member that has an opening, and a face member that includes a striking face and closes the opening. The face member includes a face portion that forms the striking face, and a peripheral portion that extends from a peripheral edge of the face portion toward a back side. The peripheral portion of the face member is welded to the body member. A weld bead that juts from the inner surface of the head is formed at a boundary position between the peripheral portion and the body member. A wall thickness at a face-side end point of the weld bead is greater than a wall thickness at a body-side end point of the weld bead. The peripheral portion has a length of less than or equal to 6 mm.

19 Claims, 10 Drawing Sheets

(56) References Cited

U.S. PATENT DOCUMENTS

2003/0119603 A1* 6/2003 Yabu ..... A63B 53/0466 473/345
2003/0148818 A1* 8/2003 Myrhum ..... A63B 69/3658 473/290
2004/0138001 A1* 7/2004 Sano ..... A63B 53/0466 473/324
2004/0185962 A1* 9/2004 Yabu ..... A63B 60/46 473/345
2006/0172819 A1* 8/2006 Sano ..... A63B 53/0466 473/345
2006/0287131 A1* 12/2006 Hirano ..... A63B 53/0466 473/345
2007/0105656 A1* 5/2007 Hirano ..... A63B 53/04 473/345
2007/0105657 A1* 5/2007 Hirano ..... A63B 53/04 473/324
2007/0202963 A1* 8/2007 Oyama ..... A63B 53/0466 473/345
2009/0118032 A1* 5/2009 Hirano ..... A63B 60/54 473/343
2009/0275425 A1* 11/2009 Hirano ..... A63B 53/0466 473/345
2009/0280926 A1* 11/2009 Hirano ..... A63B 53/0466 473/345
2010/0048325 A1* 2/2010 Tanimoto ..... A63B 60/02 29/527.5
2010/0154196 A1* 6/2010 Hirano ..... A63B 53/0466 29/527.1
2010/0317460 A1* 12/2010 Hirano ..... B23K 26/28 219/121.64
2014/0106903 A1* 4/2014 Nakamura ..... A63B 53/0466 473/346
2015/0265887 A1* 9/2015 Yamasawa ..... A63B 60/00 473/342
2015/0375068 A1* 12/2015 Mizutani ..... A63B 53/0466 473/324
2016/0184664 A1* 6/2016 Mizutani ..... A63B 60/52 473/345
2016/0184666 A1* 6/2016 Mizutani ..... A63B 53/0466 473/342
2016/0346641 A1* 12/2016 Akiyama ..... A63B 53/04
2016/0354653 A1* 12/2016 Aramaki ..... A63B 53/0466
2019/0015713 A1* 1/2019 Kato ..... A63B 53/0466
2019/0290974 A1* 9/2019 Aramaki ..... A63B 53/0466
2019/0290975 A1* 9/2019 Aramaki ..... A63B 53/0466
2020/0094116 A1* 3/2020 Kato ..... A63B 53/0466
2020/0368590 A1* 11/2020 Mizutani ..... A63B 53/0433
2023/0074992 A1* 3/2023 Mizutani ..... A63B 53/0454

FOREIGN PATENT DOCUMENTS

JP 3459792 B2 * 10/2003
JP 2003284793 A * 10/2003
JP 2004208728 A * 7/2004
JP 2004290274 A * 10/2004
JP 2004290313 A * 10/2004
JP 2007325727 A * 12/2007 ..... A63B 53/0466
JP 2010082215 A * 4/2010
JP 5844934 B1 * 1/2016 ..... A63B 53/0466
JP 5848840 B1 * 1/2016 ..... A63B 53/0466
JP 2016221170 A * 12/2016
JP 2020093172 A * 6/2020
JP 2020-191938 A 12/2020

* cited by examiner

GOLF CLUB HEAD

CROSS REFERENCE TO RELATED APPLICATION

The present application claims priority to Japanese Patent Application No. 2021-017094 filed on Feb. 5, 2021. The entire contents of this Japanese Patent Application are hereby incorporated by reference.

BACKGROUND

Technical Field

The present disclosure relates to a golf club head.

Description of the Related Art

There has been known a golf club head including a face member and a head body that are welded to each other. There also has been known a golf club head including a face member that has a cup face structure. JP2020-191938 A (US2020/0368590 A1) discloses a golf club head including a head body and a face member having a peripheral portion that are joined to each other by welding. In this head, the peripheral portion includes a thick portion joined to an end surface of an opening of the head body, and a connecting portion connecting the thick portion and a face portion. The connecting portion includes a thin portion that has a thinner wall thickness than that of the thick portion.

SUMMARY

There has been demand for a head having a higher rebound performance. The inventors of the present disclosure have found a new structure capable of enhancing rebound performance in a head including a face member and a body member that are joined to each other. The inventors of the present disclosure have found that the rebound performance of the head can be improved by increasing the rigidity of a portion that is easy to bend in a conventional head structure and by shifting the position of bending of the head. One of the objects of the present disclosure is to provide a golf club head having an enhanced rebound performance achieved with a new structure.

In one aspect, the present disclosure provides a golf club head having a head outer surface and a head inner surface, and being hollow. The head includes a body member having an opening, and a face member including a striking face and closing the opening. The face member includes a face portion that forms the striking face, and a peripheral portion that extends from a peripheral edge of the face portion toward a back side. The peripheral portion of the face member is welded to the body member. A weld bead that juts from the head inner surface is formed at a boundary position between the peripheral portion and the body member. A wall thickness at a face-side end point of the weld bead is greater than a wall thickness at a body-side end point of the weld bead. The peripheral portion has a length of less than or equal to 6 mm.

DESCRIPTION OF THE PREFERRED EMBODIMENTS

Hereinafter, the present disclosure will be described in detail according to the preferred embodiments with appropriate references to the accompanying drawings.

In the present disclosure, a reference state, a reference perpendicular plane, a toe-heel direction, a face-back direction, an up-down direction, a face center, a vertical cross section, and a radius of curvature are defined as follows.

Figure 10:
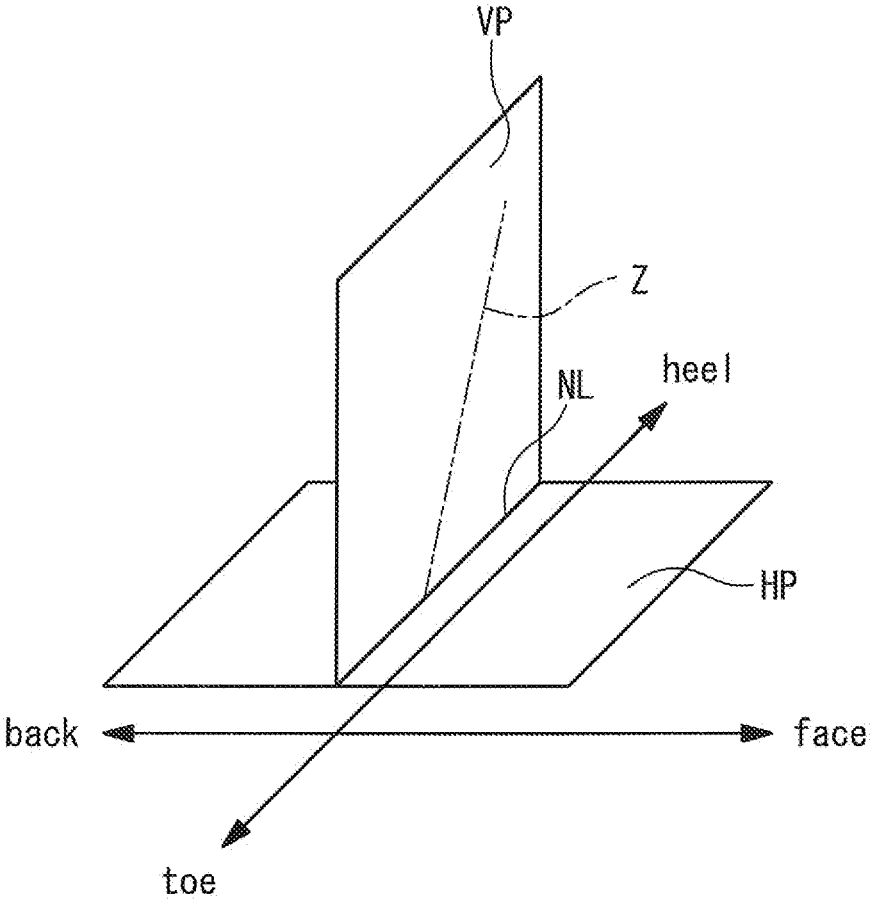
FIG. 10 is a conceptual diagram for illustrating a reference state.

The reference state is defined as a state where a head is placed at a predetermined lie angle on a ground plane HP. As shown in FIG. 10, in the reference state, a shaft axis line Z is contained in a plane VP that is perpendicular to the ground plane HP. The shaft axis line Z is the center line of a shaft. The shaft axis line Z is the center line of a hosel hole. The plane VP is defined as the reference perpendicular plane. The predetermined lie angle is shown in product catalogs, for example.

In the reference state, a face angle is 0°. That is, in a planer view of the head as viewed from above, a tangent line to the head at its face center on a striking face is set to be parallel to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 10). A toe side in the toe-heel direction is also simply referred to as "toe side". A heel side in the toe-heel direction is also simply referred to as "heel side".

In the present disclosure, the face-back direction is a direction that is perpendicular to the toe-heel direction and is parallel to the ground plane HP. A face side in the face-back direction is also simply referred to as "face side". A back side in the face-back direction is also simply referred to as "back side".

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

In the present disclosure, the vertical cross section is defined as each of cross sections taken along respective planes perpendicular to the toe-heel direction. The vertical cross section is parallel to the face-back direction. The vertical cross section is perpendicular to the ground plane HP. A contour line shown in the vertical cross section is also referred to as a vertical cross-sectional contour line. The vertical cross section can be set at each position in the toe-heel direction.

A radius of curvature of a curved surface is measured in the vertical cross section. That is, the radius of curvature of a curved surface is measured in the vertical cross-sectional contour line. The vertical cross section is taken at each of positions in the toe-heel direction. The radius of curvature is measured in each of the vertical cross sections.

The radius of curvature is determined at each of points present on the vertical cross-sectional contour line. The radius of curvature is determined by specifying three points on the vertical cross-sectional contour line: a point to be measured (hereinafter referred to as measurement point), a point located 0.5 mm apart from the measurement point toward one side, and a point located 0.5 mm apart from the measurement point toward the other side. The radius of a circle that passes through these three points is defined as the radius of curvature at the measurement point. "0.5 mm" for these points is a route distance measured along the vertical cross-sectional contour line. This "0.5 mm" is a sufficiently small distance for evaluating the radius of curvature at a measurement point. By specifying the two points located 0.5 mm apart from a measurement point, the radius of curvature at each point on a free-form curve can be determined without the need to solve the differential equation of a cross-sectional contour line.

The radius of curvature is determined for each point in the above-described manner. In the present disclosure, when the radius of curvature of a certain portion or a certain region is defined as greater than or equal to X mm and less than or equal to Y mm, this means that the radius of curvature at each of all points present in the portion or region is greater than or equal to X mm and less than or equal to Y mm.

In the vertical cross section of the present disclosure, points located on the head inner surface and points located on the head outer surface correspond to each other as follows. As to a certain point A located on the head outer surface, a line normal to the head outer surface at the point A is drawn. An intersection point between this normal line and the head inner surface is denoted by a point B, the point A and the point B correspond to each other. This can also be described such that the point A corresponds to the point B, or the point B corresponds to the point A.

Figure 1:
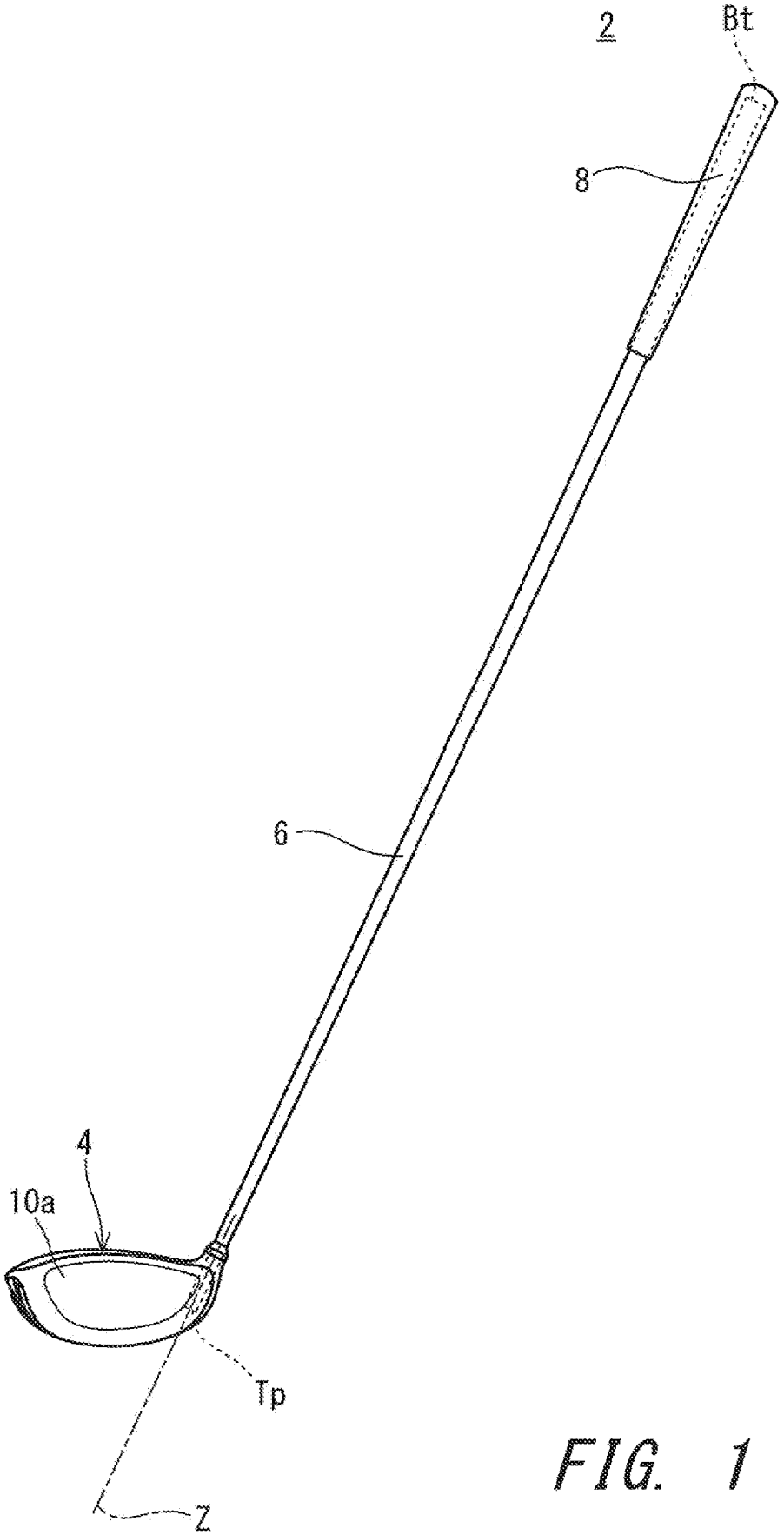
FIG. 1 shows a golf club that includes a head according to a first embodiment.
Figure 2A:
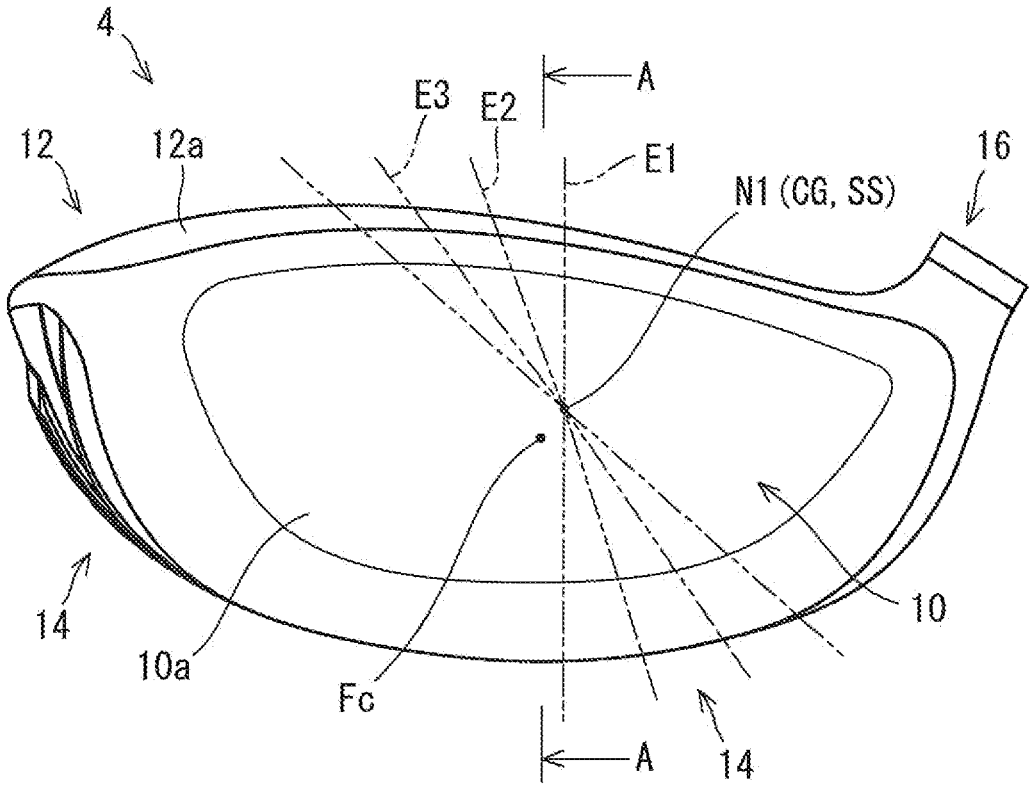
FIG. 2A is a front view of the head of the first embodiment as viewed from a face side.
Figure 2B:
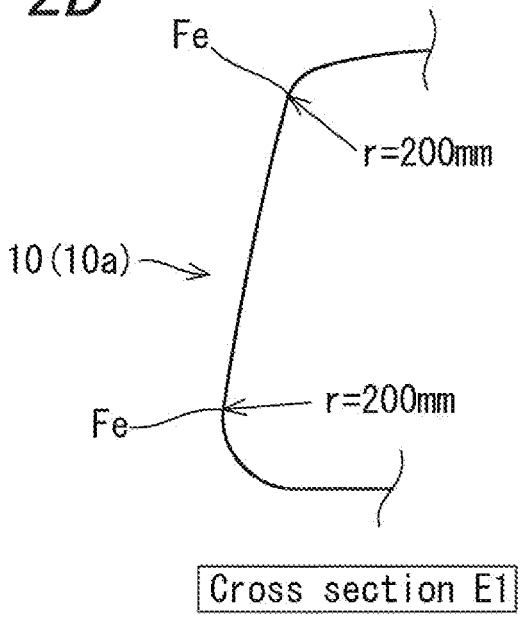
FIG. 2B shows a cross section taken along line E1 in FIG. 2A, FIG. 2B showing only a contour line in the cross section (hereinafter, also referred to as a cross-sectional contour line) of the head outer surface.
Figure 3:
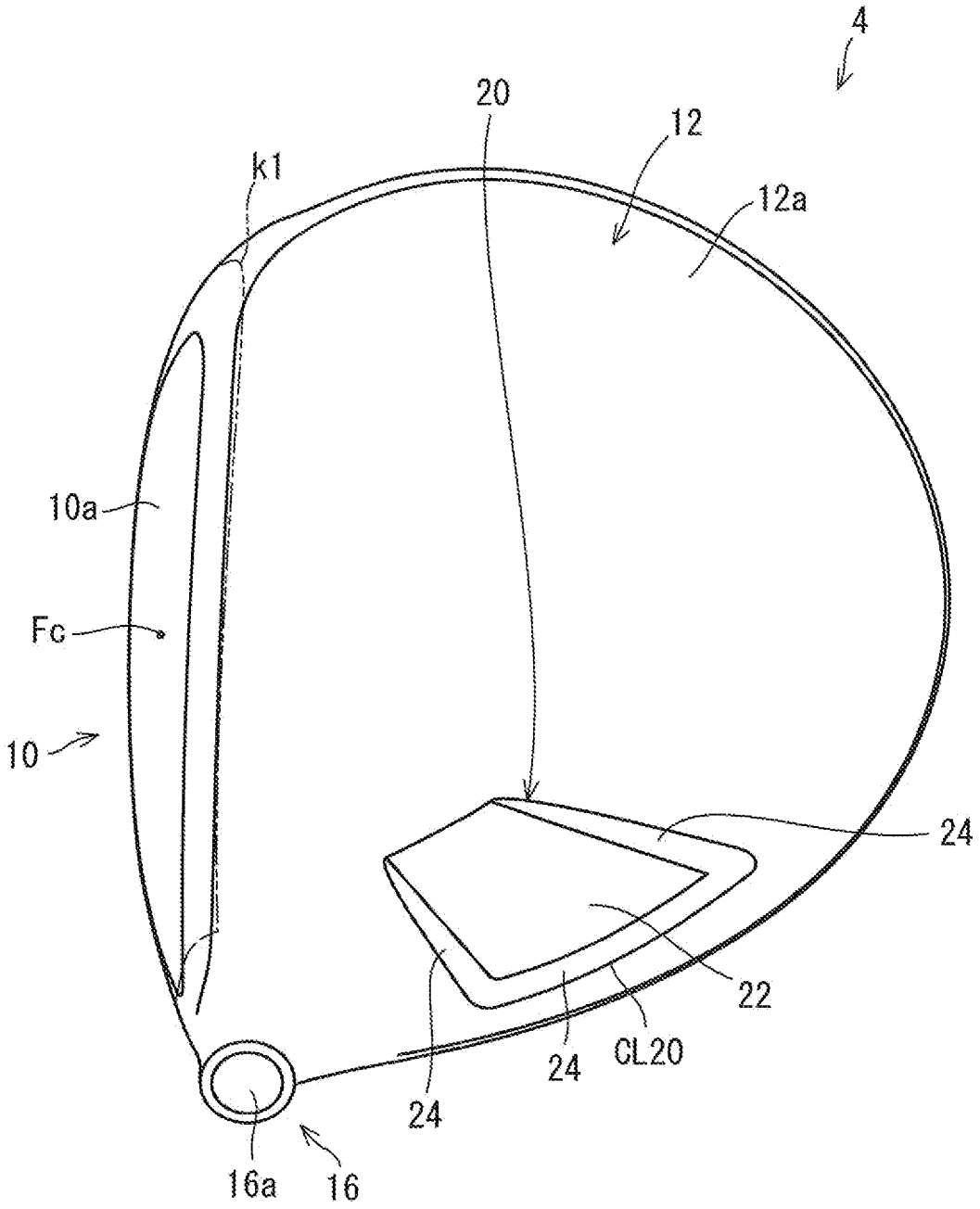
FIG. 3 is a plan view of the head of the first embodiment as viewed from a crown side.
Figure 4:
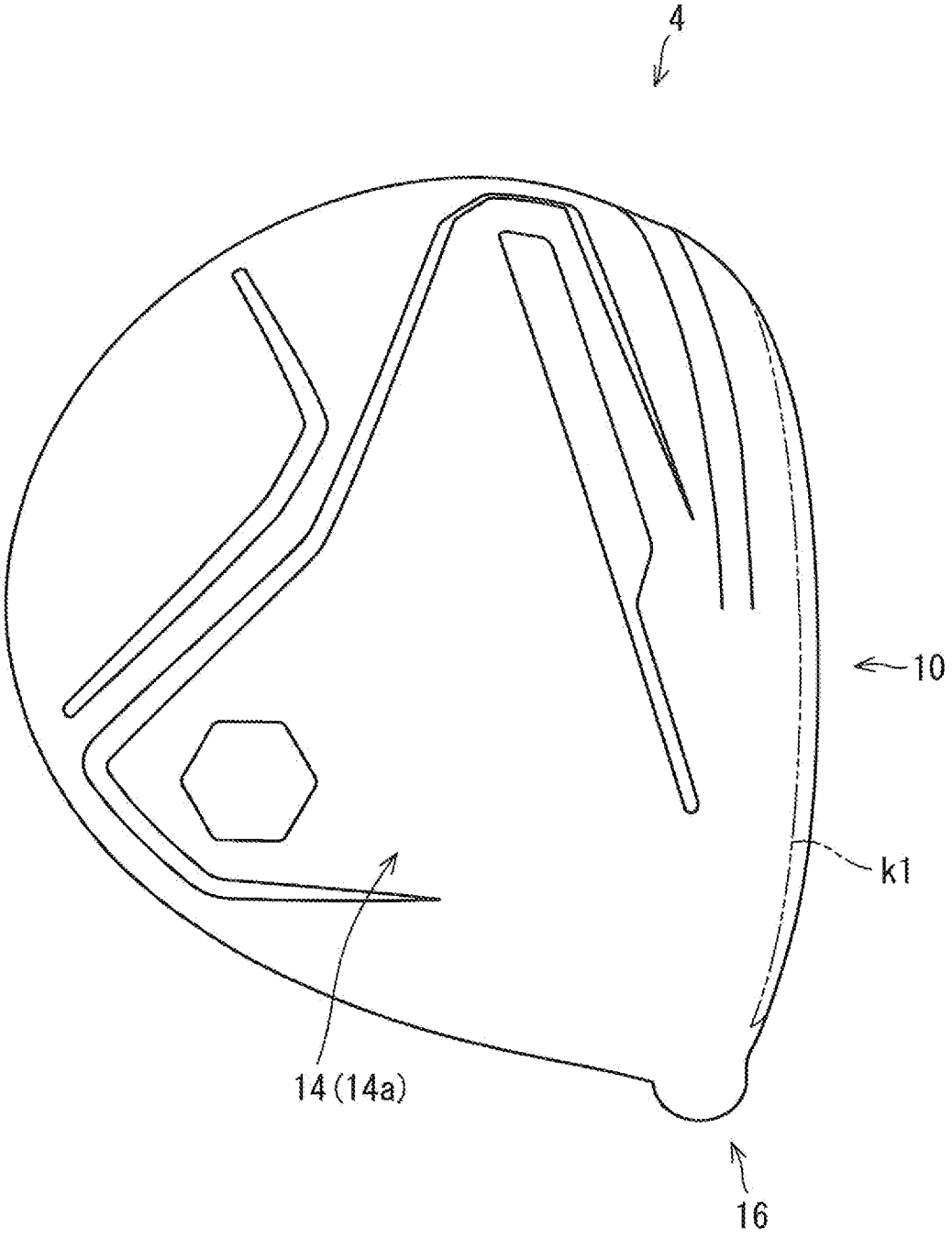
FIG. 4 is a bottom view of the head of the first embodiment as viewed from a sole side.
Figure 5:
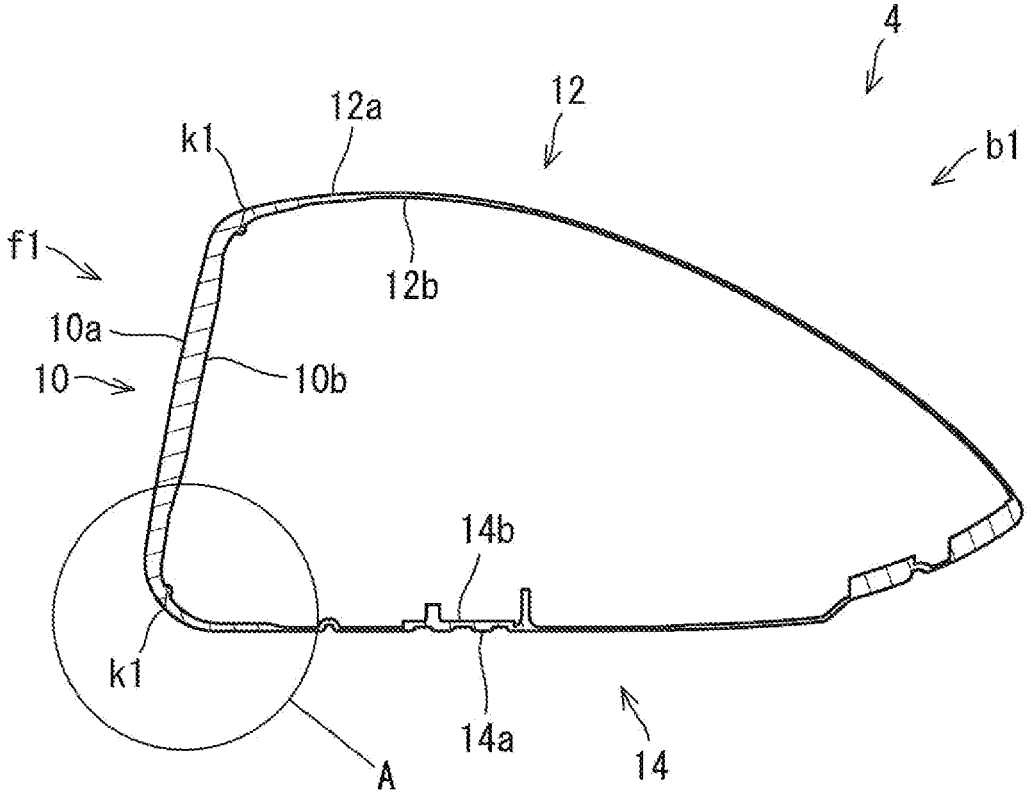
FIG. 5 is a cross-sectional view taken along line A-A in FIG. 2A.
Figure 6:
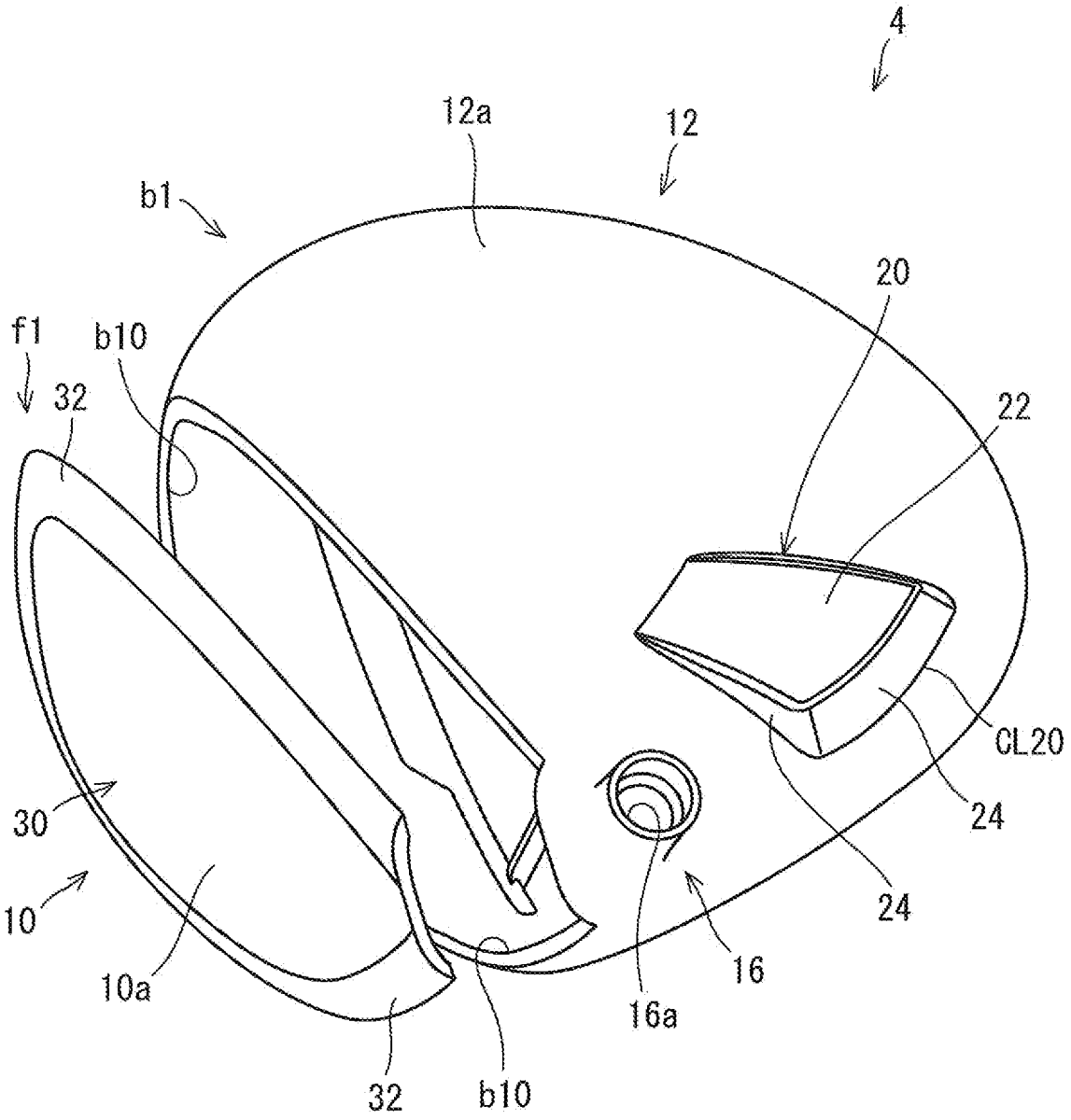
FIG. 6 is an exploded perspective view of the head of the first embodiment.

FIG. 1 is an overall view of a golf club 2 that includes a head 4 according to an embodiment of the present disclosure. FIG. 2A is a front view of the head 4, and FIG. 2B is a cross-sectional view taken along line E1 in FIG. 2A. FIG. 2B shows only a cross-sectional contour line of the outer surface of the head 4. FIG. 3 is a plan view of the head 4 as viewed from a crown side. FIG. 4 is a bottom view of the head 4 as viewed from a sole side. FIG. 5 is a cross-sectional view taken along line A-A in FIG. 2A. FIG. 5 shows a vertical cross section that passes through a face center Fc. FIG. 6 is an exploded perspective view of the head 4.

As shown in FIG. 1, the golf club 2 includes the golf club head 4, a shaft 6, and a grip 8. The shaft 6 has a tip end Tp and a butt end Bt. The head 4 is attached to a tip end portion of the shaft 6. The grip 8 is attached to a butt end portion of the shaft 6.

The golf club 2 is a driver (No. 1 wood). Preferably, the golf club 2 is a wood-type golf club or a hybrid-type golf club.

The shaft 6 is in a tubular form. The shaft 6 is hollow. The shaft 6 is made of a carbon fiber reinforced resin. From the viewpoint of reducing the weight, a carbon fiber reinforced resin is preferable as the material for the shaft 6. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. "UD" is an abbreviation of "unidirectional". A prepreg other than the UD prepreg may be used. For example, fibers contained in the prepreg sheet may be woven. The shaft 6 may include a metal wire. The material of the shaft 6 is not limited, and may be a metal, for example.

The grip 8 is a part that a golfer grips during a swing. Examples of the material of the grip 8 include rubber compositions and resin compositions. The rubber composition for the grip 8 may contain air bubbles.

As well shown in FIG. 5, the head 4 is hollow. In the present embodiment, the head 4 is a wood type head. The head 4 may be a hybrid type head. The head 4 may be an iron type head. The head 4 may be a putter type head. The head 4 is preferably a wood type head or a hybrid type head, and more preferably a wood type head. Examples of a preferable material for the head 4 include metals and fiber reinforced plastics. Examples of the metals include titanium alloys, pure titanium, stainless steel, maraging steel, and soft iron. Examples of the fiber reinforced plastics include carbon fiber reinforced plastics. The head 4 may be a composite head including a portion made of a metal and a portion made of a fiber reinforced plastic.

As shown in FIG. 2A to FIG. 4, the head 4 includes a face portion 10, a crown portion 12, a sole portion 14, and a hosel portion 16. The face portion 10 includes a striking face 10*a*. The striking face 10*a* is the outer surface of the face portion 10. The striking face 10*a* is also simply referred to as a face.

The striking face 10*a* has a face center Fc. The definition of the face center Fc is as described above. The hosel portion 16 has a shaft hole 16*a*.

A peripheral edge of the striking face 10*a* can be defined as follows. As shown in FIG. 2A and FIG. 2B, there are cross sections each of which includes a straight line N1 that connects a center of gravity CG of the head 4 and a sweet spot SS, for example, cross sections E1, E2, and E3 in FIG. 2A. In the front view of the FIG. 2A, the straight line N1 is indicated as a point. In each of the cross sections, such as the cross section E1, when a radius of curvature r of the cross-sectional contour line of the head outer surface is sequentially observed from the sweet spot SS toward the periphery of the striking face 10*a*, a point at which the radius of curvature r becomes 200 mm for the first time is defined as a position Fe. This position Fe is defined as the peripheral edge of the striking face 10*a*. Note that the sweet spot SS is a foot of a perpendicular drawn from the center of gravity CG of the head 4 to the striking face 10*a*.

As shown in FIG. 5, the face portion 10 includes a face outer surface 10*a* and a face inner surface 10*b*. The face outer surface 10*a* is the striking face. The face inner surface 10*b* faces an internal space (hollow portion) of the head 4. The crown portion 12 includes a crown outer surface 12*a* and a crown inner surface 12*b*. The crown inner surface 12*b* faces the internal space (hollow portion) of the head 4. The sole portion 14 includes a sole outer surface 14*a* and a sole inner surface 14*b*. The sole inner surface 14*b* faces the internal space (hollow portion) of the head 4.

Note that although score lines (grooves) are formed on the face outer surface 10*a*, the depiction of the score lines is omitted in the drawings of the present disclosure.

The hollow head 4 has a wall thickness. The wall thickness is the thickness between the inner surface of the head 4 and the outer surface of the head 4. For example, the wall thickness of the face portion 10 is the thickness between the striking face 10*a* and the face inner surface 10*b*. For example, the wall thickness of the sole portion 14 is the thickness between the sole outer surface 14*a* and the sole inner surface 14*b*. The wall thickness is measured along a line normal to the head outer surface. The direction of this normal line varies depending on the position on the head outer surface.

As well shown in FIG. 3, the crown portion 12 includes a crown protruding portion 20 on the crown outer surface 12*a*. The crown protruding portion 20 is hollow. That is, the crown protruding portion 20 forms a projection on the crown outer surface 12*a* and forms a recess on the crown inner surface 12*b*. The crown protruding portion 20 includes a contour line CL20, an upper surface 22, and a sidewall surface 24. In the plan view of the head 4 (FIG. 3), the crown protruding portion 20 has a substantially quadrilateral shape (substantially trapezoidal shape). The crown protruding portion 20 is provided on the heel side with respect to the face center Fc.

The face outer surface 10*a* is a three-dimensional curved surface that is convex toward the outside of the head 4. The face outer surface 10*a* includes a bulge and a roll.

In terms of constituent members, the head 4 includes a body member b1 and a face member f1. The body member b1 has a face opening b10. The face member f1 is disposed on the face opening b10. The face member f1 includes the entirety of the striking face 10*a*. The face member f1 closes the face opening b10. The face member f1 is welded to the face opening b10. The face member f1 includes a part of the crown portion 12. The face member f1 includes a part of the sole portion 14. The body member b1 includes a part of the crown portion 12. The body member b1 includes a part of the sole portion 14. The body member b1 includes the entirety of the hosel portion 16.

A two-dot chain line in FIG. 3 and FIG. 4 shows a boundary line k1 between the face member f1 and the body member b1 on the head outer surface.

There is no limitation on the material of the body member b1. Examples of the material for the body member b1 include a metal and a fiber reinforced plastic. Examples of the metal include one or more metals selected from pure titanium, a titanium alloy, stainless steel, maraging steel, an aluminum alloy, a magnesium alloy, and a tungsten-nickel alloy. Examples of the fiber reinforced plastic include a carbon fiber reinforced plastic. The body member b1 may be integrally formed as a single-piece member. The body member b1 may be formed by joining a plurality of members to each other. For example, the body member b1 may be formed by joining a member made of a metal and a member made of a carbon fiber reinforced plastic to each other. In the present embodiment, the entirety of the body member b1 is formed of a metal. There is no limitation on the method for producing the body member b1. In the present embodiment, the body member b1 is produced by casting (lost-wax precision casting).

There is no limitation on the material of the face member f1. The face member f1 is preferably made of a metal. However, at least a peripheral portion 32 (detailed later) is formed of a material that can be welded to the opening b10 of the body member b1. From the viewpoint of strength, examples of a preferable material for the face member f1 include titanium alloys and maraging steel. There is no limitation on the method for producing the face member f1. From the viewpoint of strength, the face member f1 may be produced by pressing a plate material. A rolled material may be used as the plate material. Rolled materials have few defects and high strength. In addition, rolled materials are formed with high thickness accuracy. The wall thickness accuracy of the face portion 10 is improved by using a rolled material. The face member f1 may be produced by forging, for example. The face member f1 may be produced by casting. As described below, the peripheral portion of the face member f1 in the present disclosure has a short length. For this reason, the face member f1 can be easily formed by pressing or forging. In the present embodiment, the face member f1 is produced by pressing a rolled material. More specifically, the producing process of the face member f1 may include: a first step of machining a plate material (rolled material) to adjust wall thickness by CNC processing; a second step of pressing the plate material after being subjected to the first step; and a third step of shaping the peripheral portion by CNC processing using the resultant material after being subjected to the second step. In the second step, a curved surface (bulge and roll) of the face portion is formed, and a bent peripheral portion is also formed. However, when the peripheral portion has a short length as in the peripheral portion 32 of the face member f1, such a short peripheral portion may make it difficult to bend the peripheral portion, and may not be completely formed by pressing only. In this case, it is preferable to perform the third step of shaping the peripheral portion after the pressing step. The shaping step in the third step includes adjusting the length of the peripheral portion and/or adjusting the shape of the outer surface of the peripheral portion. A laser cutting may be used to adjust the length of the peripheral portion. CNC processing may be used to adjust the shape of the outer surface of the peripheral portion. When the shape of the outer surface of the peripheral portion is adjusted in the third step, the wall thickness of the peripheral portion in the first step can be set considering how much the outer surface is to be trimmed in the third step. It should be noted that "CNC" is an abbreviation for Computerized Numerical Control.

Figure 7:
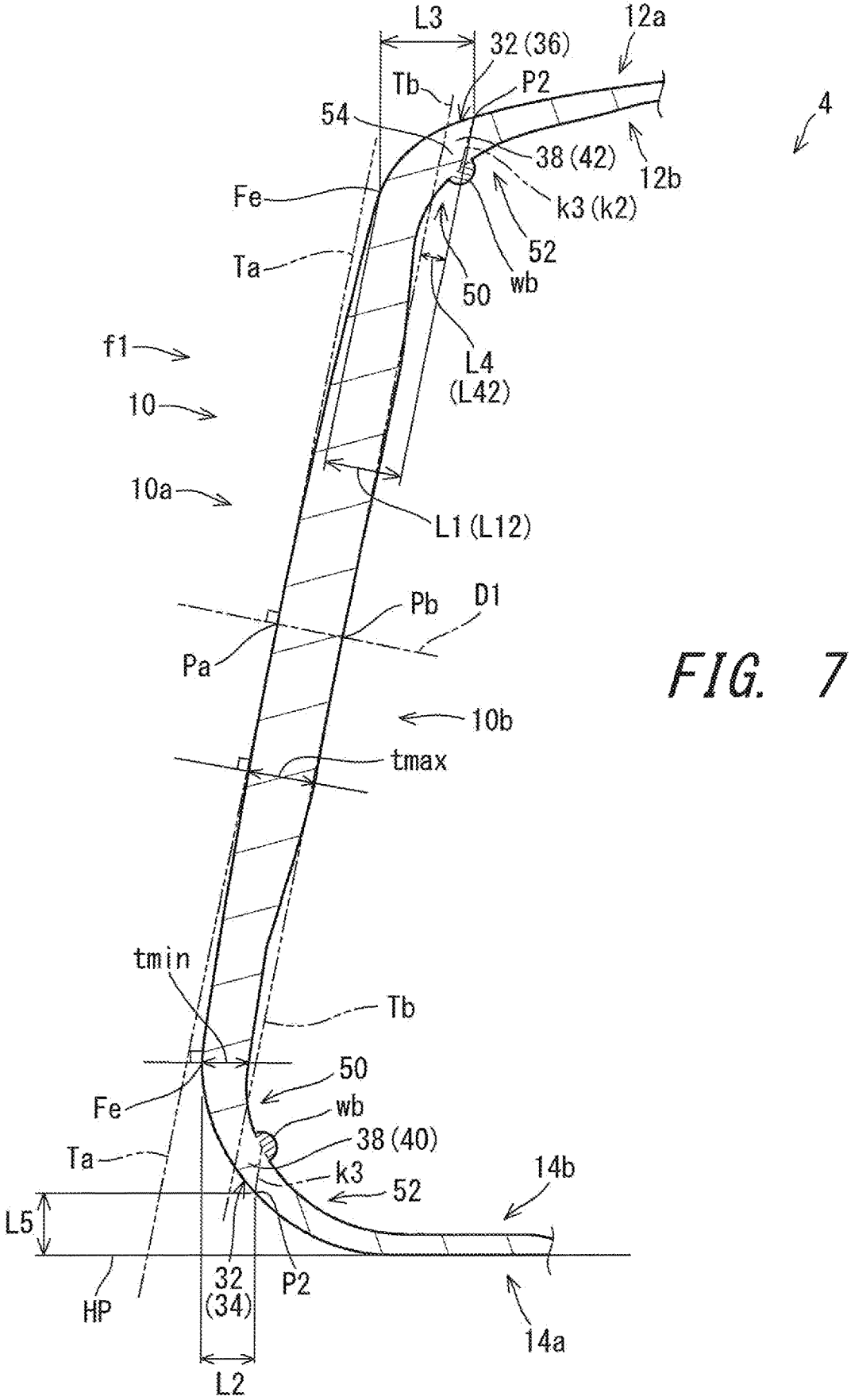
FIG. 7 is an enlarged view of a face portion and its vicinity in FIG. 5.
Figure 8:
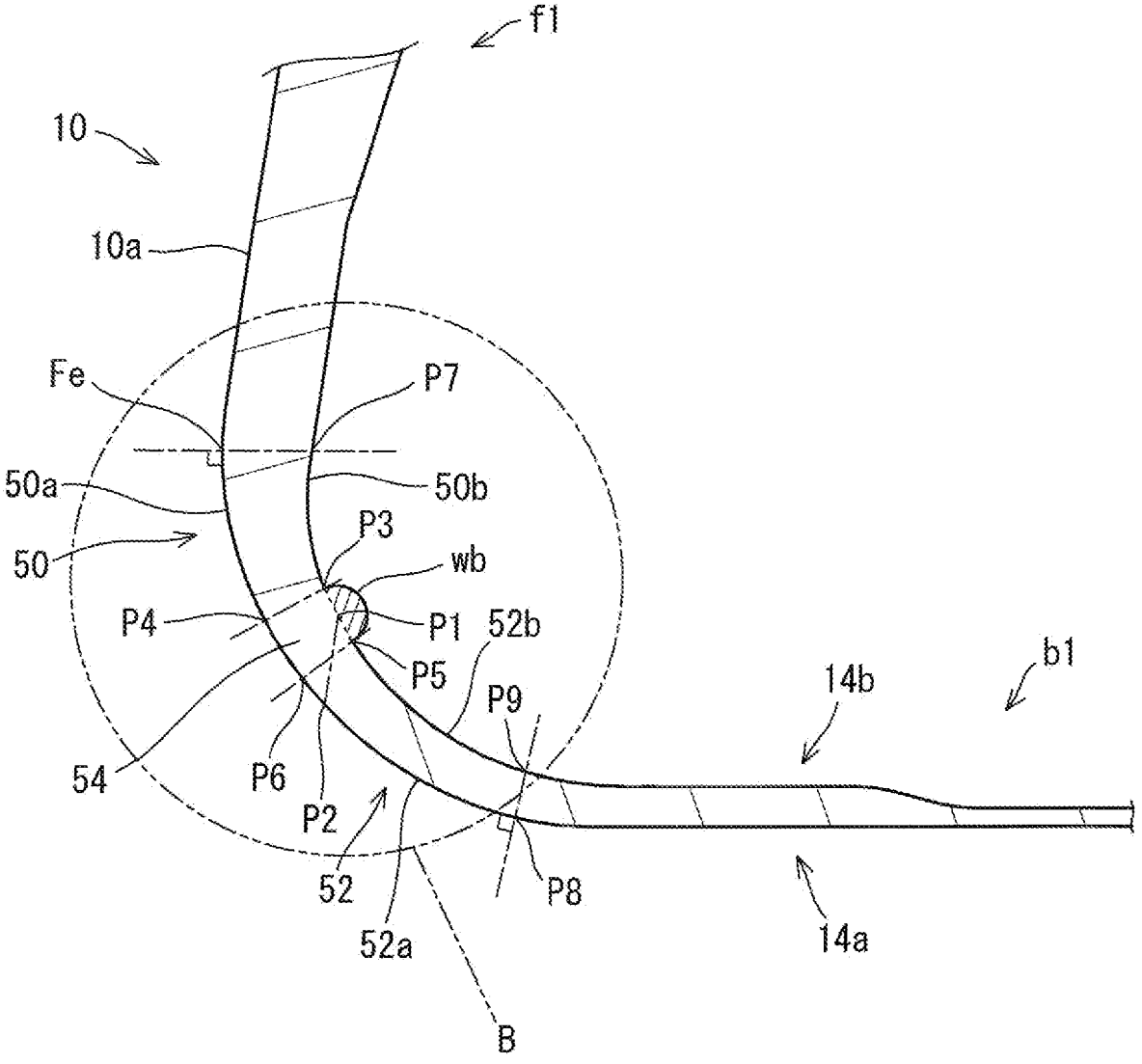
FIG. 8 is an enlarged view of a portion surrounded by a circle in FIG. 5.

FIG. 7 is an enlarged view of the face portion 10 and its vicinity in FIG. 5. FIG. 8 is an enlarged view of a portion surrounded by a circle A in FIG. 5. As described above, the head 4 includes the face member f1. The face member f1 is integrally formed as a single-piece member. The face member f1 is welded to the body member b1. A one-dot chain line(s) in FIG. 7 and FIG. 8 shows a boundary surface k2 between the face member f1 and the body member b1. The boundary surface k2 is an interface between a back-end surface of the face member f1 and a front-end surface of the body member b1. In the vertical cross section, the boundary surface k2 forms a cross-sectional boundary line k3.

Figure 9:
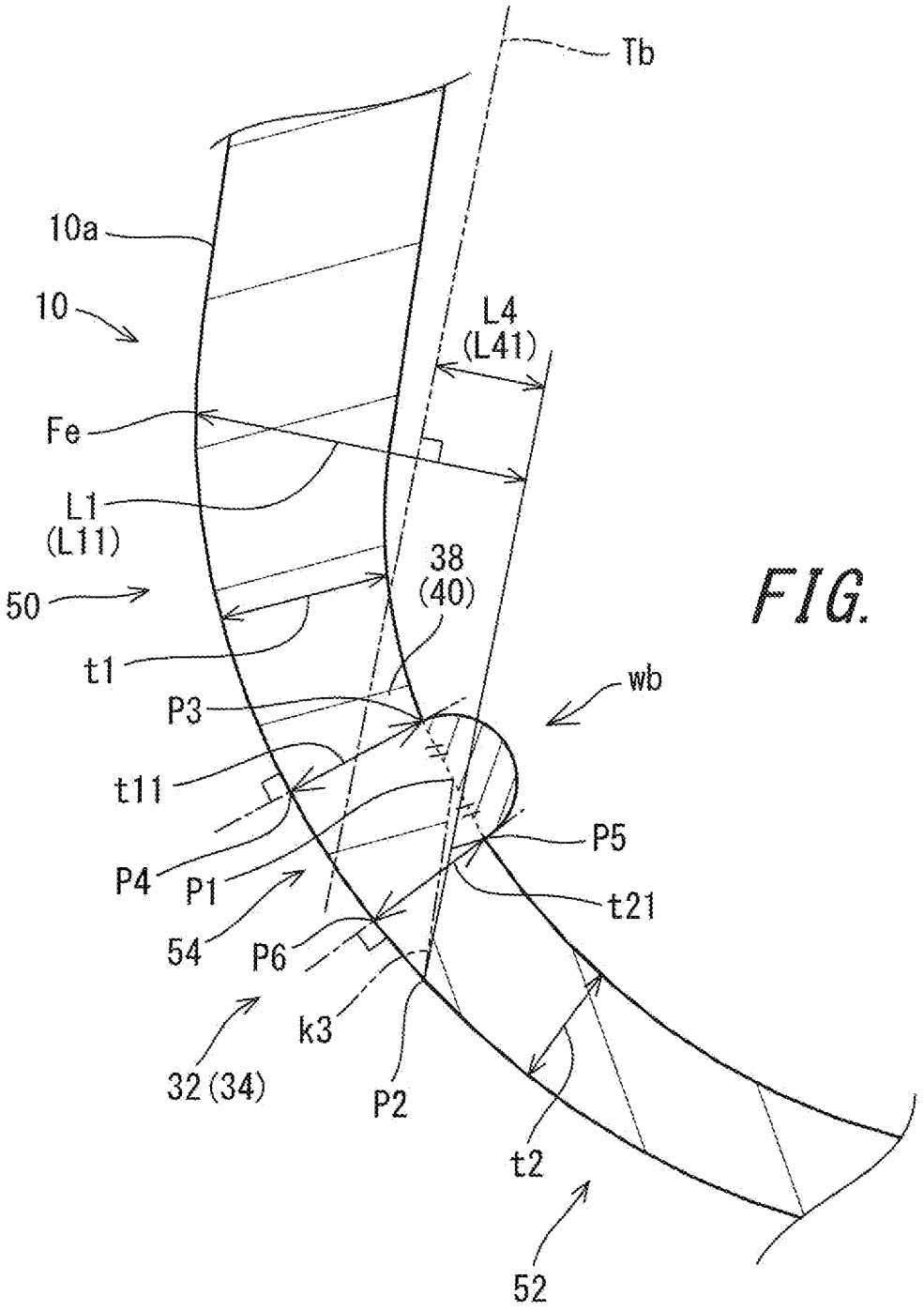
FIG. 9 is an enlarged view of a portion surrounded by a circle in FIG. 8.

FIG. 9 is an enlarged view of a portion surrounded by a circle B in FIG. 8. The cross-sectional boundary line k3 has a point P1 located on the head inner surface and a point P2 located on the head outer surface. The point P1 is covered with a weld bead wb. The cross-sectional boundary line k3 is a line segment connecting the point P1 and the point P2. The above-described boundary line k1 is a set of points P2.

The face member f1 includes the face portion 10 forming the striking face 10*a*, and the peripheral portion 32 extending from the peripheral edge of the face portion 10 toward the back side. As shown in FIG. 6, the peripheral portion 32 is provided over the entire circumference of the face member f1 except in the vicinity of the hosel portion 16. However, as shown in FIG. 6 and FIG. 7, the length of the peripheral portion 32 is short. The peripheral portion 32 includes a sole-side peripheral portion 34 and a crown-side peripheral portion 36. The sole-side peripheral portion 34 extends from a lower edge of the face portion 10 toward the back side. The crown-side peripheral portion 36 extends from an upper edge of the face portion 10 toward the back side. The back-end surface of the face member f1 is a back-end surface of the peripheral portion 32.

The weld bead wb is formed in a welded portion. The weld bead wb is formed at a boundary position between the peripheral portion 32 and the body member b1. The weld bead wb is formed on the inner surface of the head 4. The weld bead wb juts from the head inner surface. In cross-sectional views of the present disclosure, the weld bead wb is schematically shown in a semicircular shape.

There is no limitation on the method of welding. Examples of the method of welding include laser welding, arc welding, gas welding, and resistance welding. A filler material (such as a welding rod) may be used or may not be used. In the present embodiment, the welding is performed by laser welding. The weld bead wb may be formed of only a base material(s), may be formed of only the filler material, or may be formed of the base material(s) and the filler material. In the present embodiment, any filler material is not used, and the weld bead wb is formed of molten and solidified base materials (body member b1 and face member f1).

As shown in FIG. 7, in the vertical cross section, the cross-sectional contour line of the striking face 10*a* has a midpoint Pa. The midpoint Pa is a middle point of the cross-sectional contour line that extends between the peripheral edge Fe on the sole side and the peripheral edge Fe on the crown side. The midpoint Pa is determined for each vertical cross section. A tangent line Ta can be drawn for the midpoint Pa. The tangent line Ta is a tangent line to the cross-sectional contour line of the striking face 10*a* at the midpoint Pa. The face inner surface 10*b* has a point Pb. The point Pb is a point that corresponds to the point Pa. That is, the point Pb is an intersection point between the face inner surface 10*b* and a line D1 normal to the cross-sectional contour line of the striking face 10*a* at the midpoint Pa. A straight line Tb that passes through the point Pb and is parallel to the tangent line Ta is determined.

The peripheral portion 32 includes a backward extending portion 38 that extends further backward than the face portion 10. The backward extending portion 38 is a portion that extends further backward than the straight line Tb. The backward extending portion 38 includes a sole-side backward extending portion 40 and a crown-side backward extending portion 42.

As shown in FIG. 7 and FIG. 9, the peripheral portion 32 has a length L1. The length L1 of the peripheral portion 32 is a length from the peripheral edge Fe to the outer surface boundary point P2. The length L1 is measured in the direction of a line normal to the striking face (hereinafter, this direction is also referred to as a face normal direction). The face normal direction is the direction of the normal line D1 to the striking face at the midpoint Pa (see FIG. 7). Accordingly, the face normal direction is perpendicular to the tangent line Ta, and is also perpendicular to the straight line Tb. FIG. 9 shows a length L11 of the sole-side peripheral portion 34. FIG. 7 shows a length L12 of the crown-side peripheral portion 36. The length L11 and the length L12 are examples of the length L1.

As shown in FIG. 7, the sole-side peripheral portion 34 has a length L2 in the face-back direction. The length L2 is a length from the peripheral edge Fe on the sole side to the outer surface boundary point P2 on the sole side. The crown-side peripheral portion 36 has a length L3 in the face-back direction. The length L3 is a length from the peripheral edge Fe on the crown side to the outer surface boundary point P2 on the crown side. The length L3 is greater than the length L2. In the present disclosure, the length L1 of the peripheral portion 32 is not the length L2 or the length L3 measured in the face-back direction but is defined as a length measured in the face normal direction (see double-pointed arrows L1 in FIG. 7 and FIG. 9).

A double-pointed arrow L4 in FIG. 9 shows a length of the backward extending portion 38. The backward extending portion 38 has the length L4. The length L4 is a length from the straight line Tb to the end point P2. The length L4 is measured in the face normal direction. FIG. 9 shows a length L41 of the sole-side backward extending portion 40. FIG. 7 shows a length L42 of the crown-side backward extending portion 42. The length L41 and the length L42 are examples of the length L4.

After the face member f1 and the body member b1 have been welded to each other, the boundary surface k2 might no longer be recognized. Although not shown in the drawings, the above-explained welding forms a welded portion that is formed by the materials of the members being molten and then solidified at and in the vicinity of the boundary surface k2. Although not shown the drawings, the welded portion shown in the vertical cross section has an irregular shape and a width.

The welding portion can make the boundary surface k2 unclear. When the boundary surface k2 is unclear, the end points P1 and P2 of the cross-sectional boundary line k3 might also be unclear. In this case, the points P1 and P2 can be determined in the following manner. As shown in FIG. 9, in the vertical cross section, a face-side end point P3 of the weld bead wb and a body-side end point P5 of the weld bead wb are determined. Further, a midpoint of a line segment that connects the point P3 and the point P5 is determined. This midpoint is defined as the point P1. On the other hand, the point P2 can be defined as a midpoint of the cross-sectional contour line of the welded portion exposed on the outer surface of the head 4. The point P2 can be determined as the midpoint of the cross-sectional contour line which is a curved line. A line segment that connects the point P1 and the point P2 can be the cross-sectional boundary line k3 in the vertical cross section. By specifying the cross-sectional boundary line k3, dimensions of the face member f1 and the like can be specified after the face member f1 has been welded. Note that, normally, the weld bead is also formed on the outer surface of the head 4. The weld bead formed on the outer surface, however, is removed by grinding.

The point P1 is a center point of the weld bead wb, and is also referred to as a bead center point. The point P2 is also referred to as an outer surface boundary point.

In the vertical cross section, a point P4 and a point P6 are determined on the outer surface of the head 4 (see FIG. 9). The point P4 is a point that corresponds to the face-side end point P3 of the weld bead wb. The point P6 is a point that corresponds to the body-side end point P5 of the weld bead wb.

In the vertical cross section, a point P7 is determined on the inner surface of the head 4 (see FIG. 8). The point P7 is a point that corresponds to the peripheral edge Fe of the striking face 10*a*. A straight line that connects the peripheral edge Fe and the point P7 constitutes a peripheral edge of the face portion 10.

In the vertical cross section, a point P9 is determined on the inner surface of the head 4 (see FIG. 8). The point P9 is a point located 6 mm apart from the bead center point P1 toward the body member b1. This "6 mm" is a route distance measured along the cross-sectional contour line. That is, "6 mm" is the length of the cross-sectional contour line from the point P1 to the point P9. In the vertical cross section, a point P8 is determined on the outer surface of the head 4. The point P8 corresponds to the point P9.

FIG. 8 shows only the sole-side peripheral portion 34 and its vicinity. However, in the crown-side peripheral portion 36 and its vicinity, the point P1 to the point P9 are defined.

As shown in FIG. 8, the head 4 includes a face-side weld vicinity portion 50 and a body-side weld vicinity portion 52. The face-side weld vicinity portion 50 is a weld vicinity portion in the face member f1. The face-side weld vicinity portion 50 is a portion that extends from the peripheral edge Fe of the striking face 10*a* to the weld bead wb. The body-side weld vicinity portion 52 is a weld vicinity portion in the body member b1. The body-side weld vicinity portion 52 is a portion that extends from the weld bead wb to a point located 6 mm apart from the bead center point P1 toward the body side. On the sole side, the outer surface of the body-side weld vicinity portion 52 constitutes a part of the sole outer surface 14*a*.

An inner surface 50*b* of the face-side weld vicinity portion 50 is a region that extends from the end point P3 to the point P7. An outer surface 50*a* of the face-side weld vicinity portion 50 is a region that extends from the point P4 to the peripheral edge Fe. An inner surface 52*b* of the body-side weld vicinity portion 52 is a region that extends from the end point P5 to the point P9. An outer surface 52*a* of the body-side weld vicinity portion 52 is a region that extends from the point P6 to the point P8. The outer surface 52*a* of the body-side weld vicinity portion 52 includes the outer surface boundary point P2.

A thick-walled joint portion 54 is formed between the face-side weld vicinity portion 50 and the body-side weld vicinity portion 52. The outer surface of the thick-walled joint portion 54 is a region that extends from the point P4 to the point P6. The inner surface of the thick-walled joint portion 54 is the surface of the weld bead wb. The thick-walled joint portion 54 connects the face-side weld vicinity portion 50 and the body-side weld vicinity portion 52.

A similar structure is also formed on the crown side. As shown in FIG. 7, in the vertical cross section, the head 4 includes, on the crown side thereof, a face-side weld vicinity portion 50 and a body-side weld vicinity portion 52. The outer surface of the body-side weld vicinity portion 52 on the crown side constitutes a part of the crown outer surface 12*a*. A thick-walled joint portion 54 is formed between the face-side weld vicinity portion 50 and the body-side weld vicinity portion 52.

As shown in FIG. 9, a wall thickness t1 of the face-side weld vicinity portion 50 decreases as its proximity to the face portion 10 decreases. The wall thickness t1 continuously decreases as its proximity to the face portion 10 decreases. The wall thickness t1 may decrease stepwise as its proximity to the face portion 10 decreases.

As shown in FIG. 9, a wall thickness t2 of the body-side weld vicinity portion 52 decreases as its proximity to the face portion 10 decreases. The wall thickness t2 continuously decreases as its proximity to the face portion 10 decreases. The wall thickness t2 may decrease stepwise as its proximity to the face portion 10 decreases.

It should be noted that the word "stepwise" used for wall thickness means that the wall thickness does not have to change in a stairs manner. That is, a configuration in which a portion having a constant wall thickness and a portion having a wall thickness continuously changing are connected to each other without a step is included in the concept of "stepwise".

The wall thickness t1 includes a wall thickness t11 at the face-side end point P3 of the weld bead wb. The wall thickness t11 is the length of a line segment that connects the point P3 and the point P4. The wall thickness t11 is the wall thickness at the face-side end point P3 of the weld bead wb. The wall thickness t11 is the minimum wall thickness (has a minimum value) of the wall thickness t1. The wall thickness t2 includes a wall thickness t21 at the body-side end point P5 of the weld bead wb. The wall thickness t21 is the length of a line segment that connects the point P5 and the point P6. The wall thickness t21 is the wall thickness at the body-side end point P5 of the weld bead wb. The wall thickness t21 is the maximum wall thickness (has a maximum value) of the wall thickness t2.

The wall thickness t11 at the face-side end point P3 of the weld bead wb is greater than the wall thickness t21 at the body-side end point P5 of the weld bead wb.

The inner surface of the face-side weld vicinity portion 50 forms a smooth and continuous curved surface. The inner surface of the face-side weld vicinity portion 50 has a radius of curvature that falls in a predetermined range. The inner surface of the body-side weld vicinity portion 52 forms a smooth and continuous curved surface. The inner surface of the body-side weld vicinity portion 52 has a radius of curvature that falls in a predetermined range. The outer surface of the face-side weld vicinity portion 50 and the outer surface of the body-side weld vicinity portion 52 are made continuous with each other with the outer surface of the thick-walled joint portion 54 locating between the outer surface of the face-side weld vicinity portion 50 and the outer surface of the body-side weld vicinity portion 52. These outer surfaces have radii of curvature that fall in a predetermined range, and are smoothly continuous with each other.

As shown in FIG. 7, the face portion 10 has a maximum thickness tmax and a minimum thickness tmin. The maximum thickness tmax is the maximum value of the wall thickness of the face portion 10. The minimum thickness tmin is the minimum value of the wall thickness of the face portion 10. Although the maximum thickness tmax and the minimum thickness tmin are shown in FIG. 7, the maximum thickness tmax and the minimum thickness tmin may not actually be present in the vertical cross section passing through the face center Fc.

The head 4 exhibits the following advantageous effects.

The face member f1 is a cup-shaped face, and includes the peripheral portion 32. Accordingly, there is no welded portion in the face portion 10. In a welded portion, the presence of a weld bead increases wall thickness and enhances rigidity. Therefore, if such a welded portion is present in the face portion 10, the deflection of the face portion 10 can be suppressed due to the presence of the welded portion. In the face member f1, since a welded portion is not present in the face portion 10, the deflection of the entire face portion 10 is easily obtained.

In the head 4, the length L1 of the peripheral portion 32 is set to as short as less than or equal to 6 mm. For this reason, the welded portion between the face member f1 and the body member b1 is located in the vicinity of the boundary between the face portion 10 and the crown portion 12. Further, the welded portion between the face member f1 and the body member b1 is located in the vicinity of the boundary between the face portion 10 and the sole portion 14. The weld bead that juts from the head inner surface is formed on the welded portion. This configuration enhances the rigidity of the vicinity of the boundary portions (boundary portion between the face portion and the crown portion, and boundary portion between the face portion and the sole portion) of the face portion 10. Accordingly, the boundary between the face portion 10 and the crown portion 12 and the boundary between the face member f1 and the sole portion 14 are less likely to bend. As a result, the starting point of bending at impact with a golf ball (hereinafter, simply referred to as impact) can be shifted to the body side (back side).

The wall thickness t11 at the face-side end point P3 of the weld bead wb is greater than the wall thickness t21 at the body-side end point P5 of the weld bead wb. Accordingly, a portion closer to the face portion has an increased rigidity, and the starting point of bending at impact can be shifted to the body side.

By shifting the starting point of bending toward the body side, the deflection of the face portion 10 at impact extends to the body member b1 located apart from the face portion 10. This deformation of the body member b1 (the crown portion 12 and the sole portion 14) increases the amount of deflection of the entire face portion 10 as compared with a case where the boundary portion of the face portion 10 bends. As a result, the rebound performance is enhanced. This effect is also referred to as a body deflection effect.

From the viewpoint of the body deflection effect, the length L1 of the peripheral portion 32 is preferably less than or equal to 6.0 mm, more preferably less than or equal to 5.5 mm, and still more preferably less than or equal to 5.0 mm. When the weld bead wb is positioned too close to the face portion 10, the deformation of the face portion 10 is suppressed, and the boundary portion of the face portion 10 is more easily bent. From this viewpoint, the length L1 is preferably greater than or equal to 2.5 mm, more preferably greater than or equal to 2.7 mm, and still more preferably greater than or equal to 3.0 mm.

From the viewpoint of the body deflection effect on the sole side, the length L11 of the sole-side peripheral portion 34 is preferably less than or equal to 6.0 mm, more preferably less than or equal to 5.5 mm, and still more preferably less than or equal to 5.0 mm. When the weld bead wb is positioned too close to the face portion 10, the deformation of the face portion 10 is suppressed, and the boundary portion of the face portion 10 is more easily bent. From this viewpoint, the length L11 is preferably greater than or equal to 2.5 mm, more preferably greater than or equal to 2.7 mm, and still more preferably greater than or equal to 3.0 mm.

From the viewpoint of the body deflection effect on the crown side, the length L12 of the crown-side peripheral portion 36 is preferably less than or equal to 6.0 mm, more preferably less than or equal to 5.5 mm, and still more preferably less than or equal to 5.0 mm. When the weld bead wb is positioned too close to the face portion 10, the deformation of the face portion 10 is suppressed, and the boundary portion of the face portion 10 is more easily bent. From this viewpoint, the length L12 is preferably greater than or equal to 2.5 mm, more preferably greater than or equal to 2.7 mm, and still more preferably greater than or equal to 3.0 mm.

When the weld bead wb is positioned too close to the face portion 10, the deformation of the face portion 10 is suppressed, and the boundary portion of the face portion 10 is more easily bent. From this viewpoint, the length L1 of the peripheral portion 32 is preferably greater than the minimum thickness tmin, and is more preferably greater than the maximum thickness tmax.

On the sole side, when the weld bead wb is positioned too close to the face portion 10, the deformation of the sole-side part of the face portion 10 can be suppressed. From this viewpoint, the length L11 of the sole-side peripheral portion 34 is preferably greater than the minimum thickness tmin of the face portion 10, and is more preferably greater than the maximum thickness tmax of the face portion 10.

On the crown side, when the weld bead wb is positioned too close to the face portion 10, the deformation of the crown-side part of the face portion 10 can be suppressed. From this viewpoint, the length L12 of the crown-side peripheral portion 36 is preferably greater than the minimum thickness tmin, and is more preferably greater than the maximum thickness tmax.

From the viewpoint of the body deflection effect, the length L4 of the backward extending portion 38 is preferably less than or equal to 3.3 mm, more preferably less than or equal to 3.0 mm, and still more preferably less than or equal to 2.8 mm. When the weld bead wb is positioned too close to the face portion 10, the deformation of the face portion 10 is suppressed, and the boundary portion of the face portion 10 is more easily bent. From this viewpoint, the length L4 is preferably greater than or equal to 0.5 mm, more preferably greater than or equal to 0.7 mm, and still more preferably greater than or equal to 0.9 mm.

From the viewpoint of the body deflection effect on the sole side, the length L41 of the sole-side backward extending portion 40 is preferably less than or equal to 3.3 mm, more preferably less than or equal to 3.0 mm, and still more preferably less than or equal to 2.8 mm. When the weld bead wb is positioned too close to the face portion 10, the deformation of the face portion 10 is suppressed, and the boundary portion of the face portion 10 is more easily bent. From this viewpoint, the length L41 is preferably greater than or equal to 0.5 mm, more preferably greater than or equal to 0.7 mm, and still more preferably greater than or equal to 0.9 mm.

From the viewpoint of the body deflection effect on the crown side, the length L42 of the crown-side backward extending portion 42 is preferably less than or equal to 3.3 mm, more preferably less than or equal to 3.0 mm, and still more preferably less than or equal to 2.8 mm. When the weld bead wb is positioned too close to the face portion 10, the deformation of the face portion 10 is suppressed, and the boundary portion of the face portion 10 is more easily bent. From this viewpoint, the length L42 is preferably greater than or equal to 0.5 mm, more preferably greater than or equal to 0.7 mm, and still more preferably greater than or equal to 0.9 mm.

From the viewpoint of the body deflection effect, the length L4 of the backward extending portion 38 is preferably smaller than the maximum thickness tmax, and more preferably smaller than the minimum thickness tmin. When the weld bead wb is positioned too close to the face portion 10, the deformation of the face portion 10 is suppressed, and the boundary portion of the face portion 10 is more easily bent. From this viewpoint, it is preferable that the backward extending portion 38 is present.

From the viewpoint of the body deflection effect on the sole side, the length L41 of the sole-side backward extending portion 40 is preferably smaller than the maximum thickness tmax, and more preferably smaller than the minimum thickness tmin. When the weld bead wb is positioned too close to the face portion 10, the deformation of the face portion 10 is suppressed, and the boundary portion of the face portion 10 is more easily bent. From this viewpoint, it is preferable that the sole-side backward extending portion 40 is present.

From the viewpoint of the body deflection effect on the crown side, the length L42 of the crown-side backward extending portion 42 is preferably smaller than the maximum thickness tmax, and more preferably smaller than the minimum thickness tmin. When the weld bead wb is positioned too close to the face portion 10, the deformation of the face portion 10 is suppressed, and the boundary portion of the face portion 10 is more easily bent. From this viewpoint, it is preferable that the crown-side backward extending portion 42 is present.

L4/L1 is a ratio of the length L4 of the backward extending portion 38 to the length L1 of the peripheral portion 32. From the viewpoint of the body deflection effect, L4/L1 is preferably less than or equal to 0.55, more preferably less than or equal to 0.5, and still more preferably less than or equal to 0.45. When the weld bead wb is positioned too close to the face portion 10, the deformation of the face portion 10 is suppressed, and the boundary portion of the face portion 10 is more easily bent. From this viewpoint, L4/L1 is preferably greater than or equal to 0.08, more preferably greater than or equal to 0.1, and still more preferably greater than or equal to 0.15.

L41/L11 is a ratio of the length L41 of the sole-side backward extending portion 40 to the length L11 of the sole-side peripheral portion 34. From the viewpoint of the body deflection effect on the sole side, L41/L11 is preferably less than or equal to 0.55, more preferably less than or equal to 0.5, and still more preferably less than or equal to 0.45. When the weld bead wb is positioned too close to the face portion 10, the deformation of the face portion 10 is suppressed, and the boundary portion of the face portion 10 is more easily bent. From this viewpoint, L41/L11 is preferably greater than or equal to 0.08, more preferably greater than or equal to 0.1, and still more preferably greater than or equal to 0.15.

L42/L12 is a ratio of the length L42 of the crown-side backward extending portion 42 to the length L12 of the crown-side peripheral portion 36. From the viewpoint of body deflection effect on the crown side, L42/L12 is preferably less than or equal to 0.55, more preferably less than or equal to 0.5, and still more preferably less than or equal to 0.45. When the weld bead wb is positioned too close to the face portion 10, the deformation of the face portion 10 is suppressed, and the boundary portion of the face portion 10 is more easily bent. From this viewpoint, L42/L12 is preferably greater than or equal to 0.08, more preferably greater than or equal to 0.1, and still more preferably greater than or equal to 0.15.

The wall thickness t1 of the face-side weld vicinity portion 50 decreases as its proximity to the face portion 10 decreases (see FIG. 9). Accordingly, the starting point of bending at impact can be more effectively shifted to the back side. It is preferable that the wall thickness t1 continuously or stepwise decreases as its proximity to the face portion 10 decreases, and it is more preferable that the wall thickness t1 continuously decreases as its proximity to the face portion 10 decreases.

From the viewpoint of suppressing the bending of the face-side weld vicinity portion 50 and shifting the starting point of bending at impact toward the back side, the wall thickness t1 is preferably greater than or equal to 1.2 mm, more preferably greater than or equal to 1.3 mm, and still more preferably greater than or equal to 1.4 mm. From the viewpoint of providing an appropriate distribution of wall thickness from the face portion 10 to the body member b1, and shifting the starting point of bending toward the back side, the wall thickness t1 is preferably less than or equal to 2.0 mm, more preferably less than or equal to 1.8 mm, and still more preferably less than or equal to 1.6 mm. The wall thickness t1 is preferably smaller than the maximum thickness tmax of the face portion 10, and is more preferably smaller than the minimum thickness tmin of the face portion 10.

The wall thickness t2 of the body-side weld vicinity portion 52 decreases as its proximity to the face portion 10 decreases (see FIG. 9). Accordingly, the starting point of bending at impact can be more effectively shifted toward the body side (back side). It is preferable that the wall thickness t2 continuously or stepwise decreases as its proximity to the face portion 10 decreases, and it is more preferable that the wall thickness t2 continuously decreases as its proximity to the face portion 10 decreases.

From the viewpoint of suppressing the bending of the body-side weld vicinity portion 52 and shifting the starting point of bending at impact toward the back side, the wall thickness t2 is preferably greater than or equal to 0.8 mm, more preferably greater than or equal to 0.9 mm, and still more preferably greater than or equal to 1.0 mm. From the viewpoint of providing an appropriate distribution of wall thickness from the face portion 10 to the body member b1, and shifting the starting point of bending toward the back side, the wall thickness t2 is preferably less than or equal to 1.8 mm, more preferably less than or equal to 1.6 mm, and still more preferably less than or equal to 1.4 mm. The wall thickness t2 is preferably smaller than the maximum thickness tmax of the face portion 10, and is more preferably smaller than the minimum thickness tmin of the face portion 10. The wall thickness t2 is preferably smaller than the wall thickness t11 at the face-side end point of the weld bead wb.

By increasing the radius of curvature of the inner surface 50*b* of the face-side weld vicinity portion 50, the bending deformation of the face-side weld vicinity portion 50 is suppressed. For this reason, the starting point of bending at impact can be more effectively shifted toward the body side (back side) (see FIG. 8). From this viewpoint, the radius of curvature of the inner surface 50*b* is preferably greater than or equal to 6 mm, more preferably greater than or equal to 7 mm, and still more preferably greater than or equal to 8 mm. When this radius of curvature is excessively large, a distance in the up-down direction from the peripheral edge Fe of the striking face 10*a* to the sole portion 14 becomes excessively large, and a width in the up-down direction of the striking face 10*a* becomes small. From this viewpoint, the radius of curvature of the inner surface 50*b* is preferably less than or equal to 34 mm, more preferably less than or equal to 32 mm, and still more preferably less than or equal to 29 mm.

By increasing the radius of curvature of the outer surface 50*a* of the face-side weld vicinity portion 50, the bending deformation of the face-side weld vicinity portion 50 is suppressed. For this reason, the starting point of bending at impact can be more effectively shifted toward the body side (back side) (see FIG. 8). From this viewpoint, the radius of curvature of the outer surface 50*a* is preferably greater than or equal to 7 mm, more preferably greater than or equal to 8 mm, and still more preferably greater than or equal to 9 mm. When this radius of curvature is excessively large, the distance in the up-down direction from the peripheral edge Fe of the striking face 10*a* to the sole portion 14 becomes excessively large, and the width in the up-down direction of the striking face 10*a* becomes small. From this viewpoint, the radius of curvature of the outer surface 50*a* is preferably less than or equal to 35 mm, more preferably less than or equal to 33 mm, and still more preferably less than or equal to 30 mm.

By increasing the radius of curvature of the inner surface 52*b* of the body-side weld vicinity portion 52, the starting point of bending at impact can be more effectively shifted to the body side (back side) (see FIG. 8). From this viewpoint, the radius of curvature of the inner surface 52*b* is preferably greater than or equal to 7 mm, more preferably greater than or equal to 8 mm, and still more preferably greater than or equal to 9 mm. When this radius of curvature is excessively large, the continuousness of the shape of the curved surface from the face-side weld vicinity portion 50 to the sole portion 14 can be impaired. From this viewpoint, the radius of curvature of the inner surface 52*b* is preferably less than or equal to 34 mm, more preferably less than or equal to 32 mm, and still more preferably less than or equal to 29 mm.

By increasing the radius of curvature of the outer surface 52*a* of the body-side weld vicinity portion 52, the starting point of bending at impact can be more effectively shifted to the body side (back side) (see FIG. 8). From this viewpoint, the radius of curvature of the outer surface 52*a* is preferably greater than or equal to 7 mm, more preferably greater than or equal to 8 mm, and still more preferably greater than or equal to 9 mm. When this radius of curvature is excessively large, the continuousness of the shape of the curved surface from the face-side weld vicinity portion 50 to the sole portion 14 can be impaired. From this viewpoint, the radius of curvature of the outer surface 52*a* is preferably less than or equal to 35 mm, more preferably less than or equal to 33 mm, and still more preferably less than or equal to 30 mm.

As described above, the head 4 is placed on the ground plane HP when the head 4 is in the reference state. In the vertical cross section passing through the face center Fc, the outer surface boundary point P2 is not in contact with the ground plane HP (see FIG. 7). In the vertical cross section passing through the face center Fc, the outer surface boundary point P2 is floating off from the ground plane HP. A double-pointed arrow L5 in FIG. 7 shows a distance between the ground plane HP and the outer surface boundary point P2 in the vertical cross section passing through the face center Fc. This distance is measured in a direction that is perpendicular to the ground plane HP. From the viewpoint of the body deflection effect, the distance L5 is preferably greater than or equal to 1.2 mm, more preferably greater than or equal to 1.4 mm, and still more preferably greater than or equal to 1.6 mm. When the weld bead wb is positioned too close to the face portion 10, the deformation of the face portion 10 is suppressed, and the boundary portion of the face portion 10 is more easily bent. From this viewpoint, the distance L5 is preferably less than or equal to 5.0 mm, more preferably less than or equal to 4.5 mm, and still more preferably less than or equal to 4.0 mm.

As described above, the vertical cross section is set at each position in the toe-heel direction. By extending the above-described shapes in the toe-heel direction, the body deflection effect is enhanced. All the above-described structures are preferably satisfied in the vertical cross section passing through the face center Fc, more preferably satisfied in all vertical cross sections taken at positions falling in a range between a point located 10 mm apart from the face center Fc toward the toe side and a point located 10 mm apart from the face center Fc toward the heel side, still more preferably satisfied in all vertical cross sections taken at positions falling in a range between a point located 15 mm apart from the face center Fc toward the toe side and a point located 15 mm apart from the face center Fc toward the heel side, and yet still more preferably satisfied in all vertical cross sections taken at positions falling in a range between a point located 20 mm apart from the face center Fc toward the toe side and a point located 20 mm apart from the face center Fc toward the heel side.

From the viewpoint of transmitting a force generated on the face portion 10 by impact against a golf ball to the crown portion 12 and deforming the crown portion 12, an angle formed between the face portion 10 and the crown portion 12 is preferably close to the right angle. From the viewpoint of transmitting the force generated on the face portion 10 by impact against a golf ball to the sole portion 14 and deforming the sole portion 14, an angle formed between the face portion 10 and the sole portion 14 is preferably close to the right angle. From these viewpoints, the head preferably has a small loft angle. The real loft angle is preferably less than or equal to 16 degrees, more preferably less than or equal to 15 degrees, and still more preferably less than or equal to 14 degrees. From the viewpoint of an appropriate launch angle of a hit ball, the real loft angle is preferably greater than or equal to 7 degrees, more preferably greater than or equal to 7.5 degrees, and still more preferably greater than or equal to 8 degrees.

Regarding the above-described embodiments, the following clauses are disclosed.

[Clause 1]

A golf club head being hollow and having a head outer surface and a head inner surface, the golf club head including:

a body member that has an opening; and a face member that includes a striking face and closes the opening, wherein the face member includes a face portion that forms the striking face, and a peripheral portion that extends from a peripheral edge of the face portion toward a back side, the peripheral portion of the face member is welded to the body member, a weld bead that juts from the head inner surface is formed at a boundary position between the peripheral portion and the body member, a wall thickness at a face-side end point of the weld bead is greater than a wall thickness at a body-side end point of the weld bead, and the peripheral portion has a length of less than or equal to 6 mm.

[Clause 2]

The golf club head according to clause 1, wherein the peripheral portion includes a backward extending portion that extends further backward than the face portion.

[Clause 3]

The golf club head according to clause 1 or 2, wherein when a portion that extends from the peripheral edge of the face portion to the weld bead is defined as a face-side weld vicinity portion, and when a portion that extends from the weld bead to a position located 6 mm apart from a center point of the weld bead toward a body side is defined as a body-side weld vicinity portion, then a wall thickness of the face-side weld vicinity portion decreases as its proximity to the face portion decreases, and a wall thickness of the body-side weld vicinity portion decreases as its proximity to the face portion decreases.

[Clause 4]

The golf club head according to clause 3, wherein a radius of curvature of an inner surface of the face-side weld vicinity portion is greater than or equal to 7 mm, and a radius of curvature of an outer surface of the face-side weld vicinity portion is greater than or equal to 7 mm.

[Clause 5]

The golf club head according to any one of clauses 1 to 4, wherein the length of the peripheral portion is greater than a minimum thickness of the face portion.

[Clause 6]

The golf club head according to any one of clauses 1 to 5, wherein the peripheral portion is a sole-side peripheral portion that is formed in a sole-side part of the face member.

LIST OF REFERENCE NUMERALS

4 Golf club head
10 Face portion
10*a* Striking face
12 Crown portion
14 Sole portion
32 Peripheral portion
34 Sole-side peripheral portion
36 Crown-side peripheral portion
38 Backward extending portion
40 Sole-side backward extending portion
42 Crown-side backward extending portion
50 Face-side weld vicinity portion
52 Body-side weld vicinity portion
f1 Face member
b1 Body member
wb Weld bead
Fc Face center
Fe Peripheral edge of the striking face
P1 Bead center point
P2 Outer surface boundary point The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head being hollow and having a head outer surface, a head inner surface, and a wall thickness that is a thickness between the head inner surface and the head outer surface, the golf club head comprising:

a body member that has an opening; and a face member that includes a striking face and a face inner surface, and closes the opening, wherein the face member includes a face portion that forms the striking face, a face center that is a center of the striking face, and a peripheral portion that extends from a peripheral edge of the face portion toward a back side of the golf club head, the peripheral portion of the face member is welded to the body member, a weld bead that juts from the head inner surface is formed at a boundary position between the peripheral portion and the body member, the wall thickness at a face-side end point of the weld bead is greater than the wall thickness at a body-side end point of the weld bead, the peripheral portion has a length of greater than or equal to 2.5 mm and less than or equal to 6 mm, in a vertical cross section of the golf club head, when a tangent line to a cross-sectional contour line of the striking face at a midpoint Pa of the cross-sectional contour line of the striking face is defined as tangent line Ta, a point that is positioned on the head inner surface and that corresponds to the midpoint Pa is defined as a point Pb, and a straight line that passes through the point Pb and is parallel to the tangent line Ta is defined as straight line Tb, then the weld bead is located on the back side with respect to the straight line Tb, when a direction of a normal line that is normal to the striking face at the midpoint Pa is defined as a face normal direction, the length of the peripheral portion is a length measured from the peripheral edge of the face portion in the face normal direction, the peripheral portion includes a sole-side peripheral portion that is formed in a sole-side part of the face member, and a crown-side peripheral portion that is formed in a crown-side part of the face member, when a boundary point between the sole-side peripheral portion and the body member on the head outer surface is defined as a point P2, a distance in an up-down direction between the point P2 and a ground plane of the golf club head in the vertical cross section passing through the face center is greater than or equal to 1.2 mm, and the weld bead formed at the boundary position between the crown-side peripheral portion and the body member is located on a lower side with respect to the head inner surface at a position corresponding to a position of an uppermost point of a crown portion of the golf club head.

2. The golf club head according to claim 1, wherein the peripheral portion includes a backward extending portion that extends further backward than the face portion.

3. The golf club head according to claim 1, wherein when a portion that extends from the peripheral edge of the face portion to the weld bead is defined as a face-side weld vicinity portion, and when a portion that extends from the weld bead to a position located 6 mm apart from a center point of the weld bead toward a body side is defined as a body-side weld vicinity portion, then a wall thickness of the face-side weld vicinity portion decreases as its proximity to the face portion decreases, and a wall thickness of the body-side weld vicinity portion decreases as its proximity to the face portion decreases.

4. The golf club head according to claim 3, wherein the face-side weld vicinity portion has an inner surface that constitutes a curved surface and an outer surface that constitutes a curved surface, a radius of curvature of the inner surface of the face-side weld vicinity portion is greater than or equal to 7 mm, and a radius of curvature of the outer surface of the face-side weld vicinity portion is greater than or equal to 7 mm.

5. The golf club head according to claim 1, wherein the length of the peripheral portion is greater than a minimum thickness of the face portion.

6. The golf club head according to claim 3, wherein the wall thickness of the face-side weld vicinity portion is greater than or equal to 1.2 mm and less than or equal to 2.0 mm, and the wall thickness of the body-side weld vicinity portion is greater than or equal to 0.8 mm and less than or equal to 1.8 mm.

7. The golf club head according to claim 2, wherein the backward extending portion has a length of greater than or equal to 0.5 mm and less than or equal to 3.3 mm.

8. The golf club head according to claim 2, wherein when a length of the backward extending portion is denoted by L4 and the length of the peripheral portion is denoted by L1, the length L4 of the backward extending portion being a backwardly protruding length from an intersection point between the normal line and the face inner surface and being measured along the normal line, then L4/L1 is greater than or equal to 0.08 and less than or equal to 0.55.

9. The golf club head according to claim 2, wherein a length of the backward extending portion is smaller than a maximum thickness of the face portion.

10. The golf club head according to claim 1, wherein when a portion that extends from the peripheral edge of the face portion to the weld bead is defined as a face-side weld vicinity portion, the face-side weld vicinity portion has an inner surface that constitutes a curved surface, and a radius of curvature of the inner surface of the face-side weld vicinity portion is greater than or equal to 7 mm.

11. The golf club head according to claim 1, wherein when a portion that extends from the weld bead to a position located 6 mm apart from a center point of the weld bead toward a body side is defined as a body-side weld vicinity portion, the body-side weld vicinity portion has an inner surface that constitutes a curved surface, and a radius of curvature of the inner surface of the body-side weld vicinity portion is greater than or equal to 7 mm.

12. A golf club head being hollow and having a head outer surface, a head inner surface, and a wall thickness that is a thickness between the head inner surface and the head outer surface, the golf club head comprising:

a body member that has an opening; and a face member that includes a striking face and closes the opening, wherein the face member includes a face portion that forms the striking face, a face center that is a center of the striking face, and a peripheral portion that extends from a peripheral edge of the face portion toward a back side of the golf club head, the peripheral portion of the face member is welded to the body member, a weld bead that juts from the head inner surface is formed at a boundary position between the peripheral portion and the body member, the wall thickness at a face-side end point of the weld bead is greater than the wall thickness at a body-side end point of the weld bead, the peripheral portion has a length of greater than or equal to 2.5 mm and less than or equal to 6 mm, the peripheral portion includes a sole-side peripheral portion that is formed in a sole-side part of the face member, in a vertical cross section of the golf club head, when a tangent line to a cross-sectional contour line of the striking face at a midpoint Pa of the cross-sectional contour line of the striking face is defined as tangent line Ta, a point that is positioned on the head inner surface and that corresponds to the midpoint Pa is defined as a point Pb, and a straight line that passes through the point Pb and is parallel to the tangent line Ta is defined as straight line Tb, then the weld bead is located on the back side with respect to the straight line Tb, when a direction of a normal line that is normal to the striking face at the midpoint Pa is defined as a face normal direction, the length of the peripheral portion is a length measured from the peripheral edge of the face portion in the face normal direction, and when a boundary point between the sole-side peripheral portion and the body member on the head outer surface is defined as a point P2, a distance in an up-down direction between the point P2 and a ground plane of the golf club head in the vertical cross section passing through the face center is greater than or equal to 1.2 mm.

13. The golf club head according to claim 12, wherein the sole-side peripheral portion includes a sole-side backward extending portion that extends further backward than the face portion, and a length of the sole-side backward extending portion is smaller than a maximum thickness of the face portion.

14. The golf club head according to claim 12, wherein a portion that extends from the peripheral edge of the face portion to the weld bead is defined as a face-side weld vicinity portion, the face-side weld vicinity portion has an inner surface that constitutes a curved surface, a radius of curvature of the inner surface of the face-side weld vicinity portion is greater than or equal to 7 mm.

15. The golf club head according to claim 14, wherein a wall thickness of the face-side weld vicinity portion decreases as its proximity to the face portion decreases.

16. A golf club head being hollow and having a head outer surface, a head inner surface, and a wall thickness that is a thickness between the head inner surface and the head outer surface, the golf club head comprising:

a body member that has an opening; and a face member that includes a striking face and closes the opening, wherein the face member includes a face portion that forms the striking face, and a peripheral portion that extends from a peripheral edge of the face portion toward a back side of the golf club head, the peripheral portion of the face member is welded to the body member, a weld bead that juts from the head inner surface is formed at a boundary position between the peripheral portion and the body member, the wall thickness at a face-side end point of the weld bead is greater than the wall thickness at a body-side end point of the weld bead, the peripheral portion has a length of greater than or equal to 2.5 mm and less than or equal to 6 mm, in a vertical cross section of the golf club head, when a tangent line to a cross-sectional contour line of the striking face at a midpoint Pa of the cross-sectional contour line of the striking face is defined as tangent line Ta, a point that is positioned on the head inner surface and that corresponds to the midpoint Pa is defined as a point Pb, and a straight line that passes through the point Pb and is parallel to the tangent line Ta is defined as straight line Tb, then the weld bead is located on the back side with respect to the straight line Tb, when a direction of a normal line that is normal to the striking face at the midpoint Pa is defined as a face normal direction, the length of the peripheral portion is a length measured from the peripheral edge of the striking face in the face normal direction, the peripheral portion includes a crown-side peripheral portion that is formed in a crown-side part of the face member, and the weld bead formed at the boundary position between the crown-side peripheral portion and the body member is located on a lower side with respect to the head inner surface at a position corresponding to a position of an uppermost point of a crown portion of the golf club head.

17. The golf club head according to claim 16, wherein the crown-side peripheral portion includes a crown-side backward extending portion that extends further backward than the face portion, and a length of the crown-side backward extending portion is smaller than a maximum thickness of the face portion.

18. The golf club head according to claim 16, wherein when a portion that extends from the peripheral edge of the face portion to the weld bead is defined as a face-side weld vicinity portion, the face-side weld vicinity portion has an inner surface that constitutes a curved surface, and a radius of curvature of the inner surface of the face-side weld vicinity portion is greater than or equal to 7 mm.

19. The golf club head according to claim 18, wherein a wall thickness of the face-side weld vicinity portion decreases as its proximity to the face portion decreases.

* * * * *